US006182535B1

(12) United States Patent
Phillips

(10) Patent No.: US 6,182,535 B1
(45) Date of Patent: Feb. 6, 2001

(54) FUSE INSERTION DEVICE

(75) Inventor: Paul Laverl Phillips, Bethany, OK (US)

(73) Assignee: Lucent Technologies Inc., Murray Hill, NJ (US)

( * ) Notice: Under 35 U.S.C. 154(b), the term of this patent shall be extended for 0 days.

(21) Appl. No.: 09/199,895

(22) Filed: Nov. 25, 1998

(51) Int. Cl.[7] ..... B25B 27/14
(52) U.S. Cl. ..... 81/3.8; 81/DIG. 2; 74/127
(58) Field of Search ..... 81/3.8, DIG. 2; 74/127

(56) References Cited

U.S. PATENT DOCUMENTS 1,401,817 * 12/1921 Roberts ..... 81/DIG. 2 X
1,513,212 * 10/1924 Beale et al. ..... 81/DIG. 2 X
2,301,413 * 11/1942 Kilcup ..... 74/127 X
2,648,364 * 8/1953 Cirekka ..... 81/DIG. 2 X
4,306,599 * 12/1981 Kurahashi ..... 74/127

* cited by examiner

*Primary Examiner*—James G. Smith

(74) *Attorney, Agent, or Firm*—Sitrick & Sitrick

(57) ABSTRACT

A semi-automatic fuse and cap insertion tool includes a socket mounted on a rotatable shaft, which shaft is mounted in a gun-like holder structure. A resilient means between the shaft and the holder keeps the shaft in a first position. With a fuse and cap in said socket and the gun shaft aimed for linear movement toward the fuse block, a linear pressure force in the direction of the fuse and cap and release of a trigger latch means causes the shaft to move into a gun-like barrel recess in the holder to a second position. During such movement, a cam follower fixed in the gun barrel interior rides in a helical grove in the shaft to cause the shaft fuse and cap in this socket to rotate relative to the gun-like structure and lock the fuse in the block. In a first position, the trigger initially blocks movement of the shaft and the shaft in the first position to thereby allow a certain amount of pressure to be applied to move the fuse and cap into place in the block and against a spring in the fuse cap. Upon movement of the trigger to a second position, the shaft is released and the consequent rotation effects locking of the fuse cap in a fuse block. Springs between the shaft and the holder returns the shaft to its original first position and a spring between the holder and the trigger returns the trigger to its first position so that the shaft and socket are ready for the next repetition.

13 Claims, 2 Drawing Sheets

FUSE INSERTION DEVICE

BACKGROUND OF THE INVENTION

This invention generally relates to a semi-automatic fuse and cap insertion device that allows efficient installation of a fuse and fuse cap in a fuse block. The device allows straight-line hand movement to rotate the fuse and cap, thereby avoiding a repetitious twisting movement of the hand and wrist which is less efficient and causes fatigue.

DESCRIPTION OF THE PRIOR ART

Fuses necessary to protect sensitive electrical equipment from unexpected power surges caused by electrical shorts or power spikes require efficient installation by workers during assembly or later replacement. With the on-going efforts to reduce the size of equipment, the equipment interiors are becoming much more cramped and fuses are becoming harder to insert by hand. Also, with the proliferation of electrical equipment protected by fuses and the deteriorating supply of electrical energy causing increasing numbers of power failures that tend to blow fuses in large areas at the same time, there is an increasing need for efficient insertion, removal and replacement of fuses.

Currently, most fuses and caps are inserted into blocks by hand or with primitive screwdriver-like tools that require repetitious motion in the insertion, pushing and twisting of the small holders until proper seating is effected. This repetitious hand and wrist movement is inefficient and tiring.

SUMMARY OF THE INVENTION

The present inventions improve user efficiencies and avoid the fatigue problems by converting straight axial movement into rotary movement upon the release of a trigger.

This conversion of motion from linear to rotary is effected by a semi-automatic fuse and cap insertion tool that includes a fuse cap engaging socket mounted on a rotatable shaft, which shaft, in turn, is rotatably mounted in the barrel of a gun-like holder structure. A resilient biasing means in the barrel between the shaft and the holder keeps the shaft biased in a first position. With a fuse and cap in said socket and the gun shaft aimed for linear movement toward a fuse receiving opening in a fuse block, a linear pressure force applied in the first direction toward the fuse assembly and release of a trigger latch means from its first position blocking the shaft allows the shaft to move, in response to the pressure, into the barrel to a second position where it compresses the spring biasing means. During such movement, a cam follower fixed in the gun barrel interior rides in a helical grove in the shaft to cause the shaft as well as the fuse and cap in the socket to rotate relative to the gun-like structure and lock the fuse in the fuse block.

When the pressure in the first direction is released, the spring returns the shaft to its first position and the trigger returns to its first position.

The elimination of repetitious twisting hand and wrist motion in favor of simple linear motion avoids the problems associated with the prior art and improves worker efficiency, health, and morale. With the new tool, it is envisioned that fuse holders on caps may be greatly reduced in size since the holders or caps will not have to be designed large enough to be securely gripped and rotated by human fingers. This will allow further miniaturization of electrical devices and components which include fuses.

These and other aspects and attributes of the present invention will be discussed with reference to the following drawings and accompanying specification.

BRIEF DESCRIPTION OF THE DRAWINGS

Various other objects and teachings of the invention will become apparent when reference is made to the following detailed description considered in conjunction with the accompanying drawings, in which.

DETAILED DESCRIPTION OF THE PREFERRED EMBODIMENTS

Figure 2:
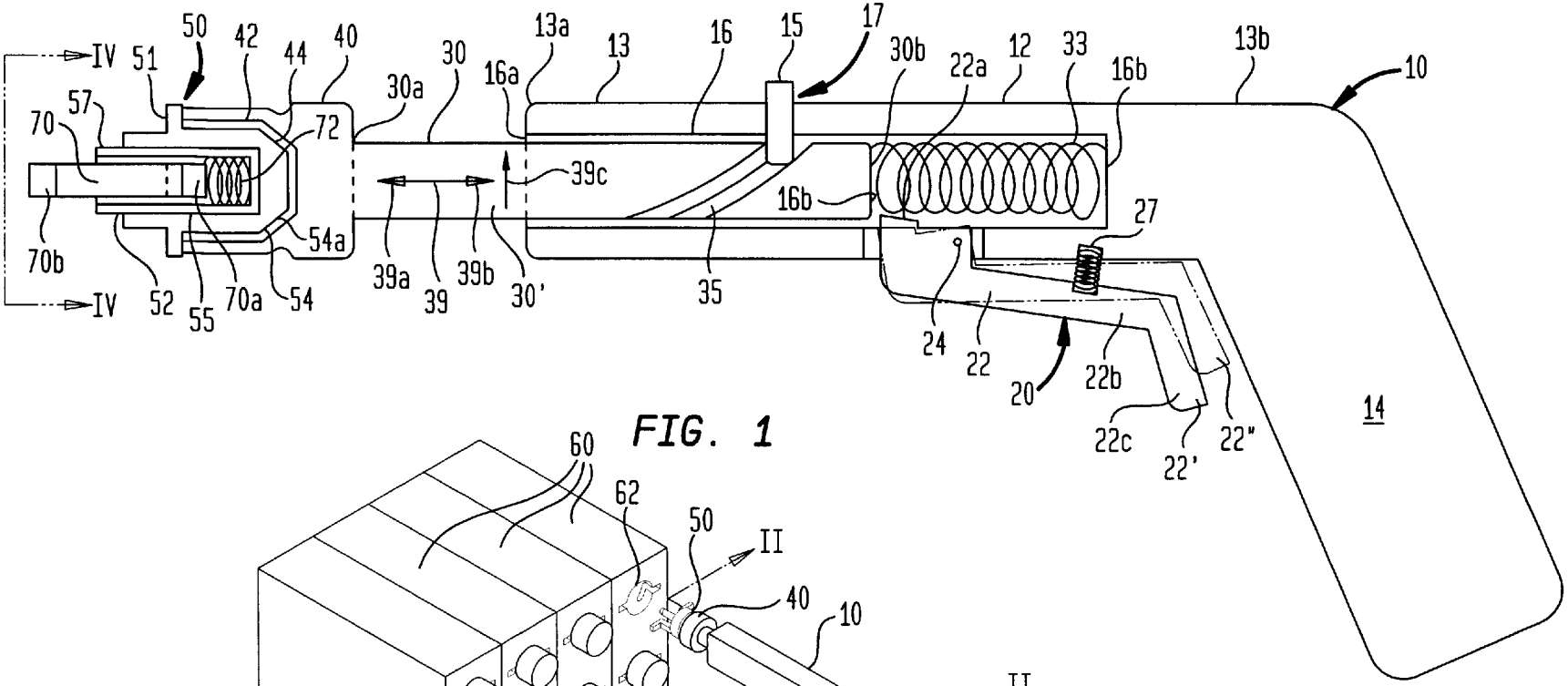
FIG. 2 is an enlarged view taken along II—II of FIG. 1 showing the operating elements with a shaft and trigger locked in a first position.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

Figure 1:
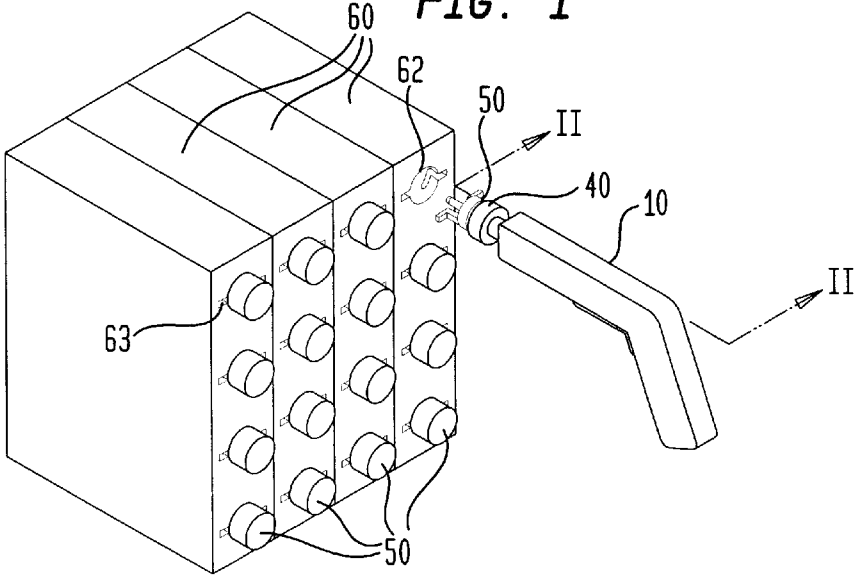
FIG. 1 is a schematic representation of a fuse insertion tool in position to insert a fuse and cap assembly into a fuse block.

The close spacing of fuses in a typical rack of fuse block 60 is schematically illustrated in FIG. 1, wherein a fuse insertion tool generally indicated at 10 is shown with a head 40 holding a fuse assembly 50 in position in front of and axially aligned with a fuse receiving opening 62 in a fuse block 60.

Figure 3:
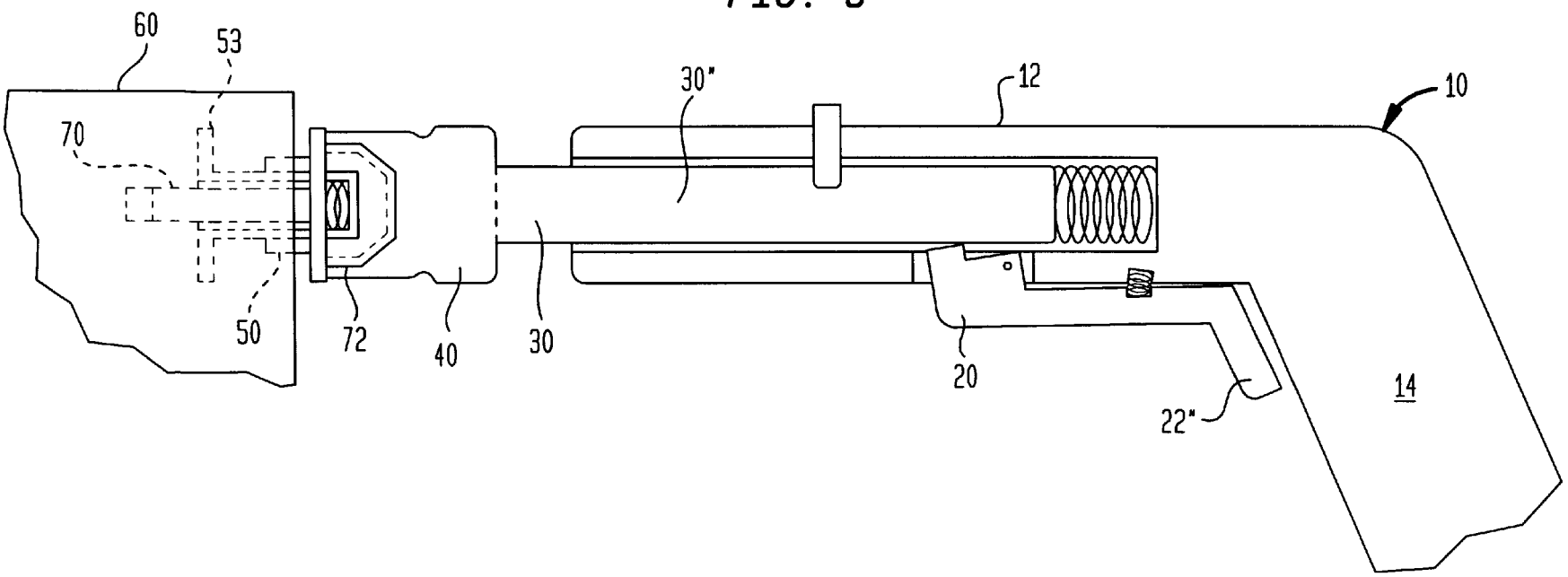
FIG. 3 is a view similar to FIG. 2 with the fuse insertion tool, shaft and trigger, in the second position after rotation of the shaft and socket.

As shown in FIG. 2, the head 40 is connected to a rotatable shaft 30 that moves linearly as shown by arrow 39 between a first position illustrated in FIG. 2 and a second position 30" shown in FIG. 3, during which movement a fuse assembly 50 is inserted into a fuse block 60 and rotated to lock it in position. The fuse holder insertion tool 10 thus makes possible the conversion of linear motion along the line 39 into a rotatable motion 39*c* avoiding the twisting of hand and wrist of the user.

The fuse holder 12 has a barrel portion 13 having a first end 13*a* and a second end 13*b* with a barrel structure 16 recessed therein. The barrel 16 has a first end 16*a* with an opening receiving shaft 30 and a second end 16*b* closed. The shaft 30 has a first end 30*a* and a second end 30*b*. The first end 30*a* is connected to the head 40 and the second end 30*b* is received in the recessed barrel 16 and bears against a compression spring 33. The compression spring 33 is thus held in place between the shaft second end 30*b* and a second end 16*b* of the barrel 16. Both shaft 30 and barrel 16 are straight and preferably of a circular configuration whereby the shaft 30 may rotate in the barrel 16. The shaft 30 is thus resiliently mounted in the holder 12 for linear movement along the lines of the arrow 39 in either a first direction 39*a* or a second direction 39*b*.

A shaft rotating device 17 for converting linear movement of the shaft to rotary motion thereof includes a helically curved groove 35 in the shaft 30 and a pin 15 mounted in the holder and extending into the groove 35. The pin 15 engaging the groove 35 acts as a cam follower whereby when the shaft 30 moves linear in direction 39, it causes rotary movement 39*c* thereof.

Movement of the shaft 30 is governed by a shaft release mechanism 20 having a trigger arm 22 with a first end 22*a* and a second end 22*b*. The trigger arm 22 is pivotally mounted about a point 24 located between the first and second ends. A finger release portion 22*c* may depend from the end at 22*b* to facilitate movement of the lever 22 by the finger of a user. In a first position 22' as shown in full lines, the end 22*a* engages the second end of the shaft 30*b* to hold it stationary against linear movement. As the trigger arm 22 is pivoted about 24 to a second position 22", the end 22*a* is disengaged from the shaft allowing it to be moved by force against the compression spring 33. The holder 12 includes a handle portion 14 depending from barrel end 13*b* to facilitate grasping by the hand of a user to form a gun-like structure.

The fuse assembly device 50 includes an assembly of a generally cylindrically shaped fuse 70 and a cap 51. The cylindrically shaped fuse 70 has a first end 70*a* and a second end 70*b* and the cap 51 has a first end 52 and a second end 54. The cap has a cylindrical recess 55 in the first end which recess is adapted to receive the first end 70*a* of the fuse 70. The recess 55 also has therein a compression spring 72 resisting movement of the fuse 70 into the recess 55. The second end of the cap 54 has an outer configuration 54*a* that is multi-sided and, in practice, usually square in cross-section.

Figure 4:
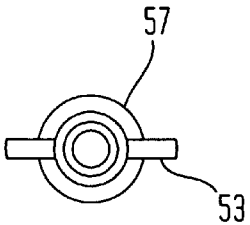
FIG. 4 is a view taken along IV—IV in FIG. 2 showing the orientation of the projections.

The fuse insertion tool head 40 includes a socket 42 with an inner configuration 44 corresponding to the outer configuration of the cap and mating with the cap configuration to hold it against rotation. The cap 51 is made of plastic and has a metallic portion 57 received in a second end 52 thereof, which metallic portion 57 has outwardly extending projections 53 as best seen in FIGS. 3 and 4. These projections 53 are adapted to be received in slots 63 in a fuse block opening.

In practice, the fuse insertion tool 10 that converts linear pushing motion into rotary motion is used in a method comprising the steps of inserting an assembly 50 of a fuse 70 and fuse cap 51 into a socket 42 in a tool head 40. The socket 42 is adapted to grip the fuse head and hold it against a rotary movement The fuse cap projections 53 extending from opposite sides of the metallic portion 57 are adapted to be received into slots 63 of openings 62 in a fuse block 60. With the fuse assembly in position, the tool is moved linearly in a first direction 39*a* toward the fuse block 60 to insert the fuse assembly 50 into an opening 62 with pressure thus applied and the head 40 and shaft 30 being held against linear or rotary motion by the trigger assembly 20. The pressure is applied to the fuse 70 compressing it against the spring 72 in the fuse holder 60. Squeezing the trigger while continuing to push forward on the tool 10 allows the shaft to rotate socket and head 40 until the projections 53 rest in the detent in the fuse block 60 and are securely locked. In practice, the helical groove is configured so the rotation is on the order of approximately 90°, however, any degree of rotation is possible. With the fuse assembly 50 in the head or socket end 40, the gun shaft is aimed and pressure applied for linear movement in the direction 39*a* toward a fuse receiving opening 62 in a fuse block 60. The release of the trigger latch portion 22*a* blocking the shaft in a first position 22' allows movement of the shaft 30 into the barrel 16 in response to the pressure applied in a direction 39*a*. In this second position 22", it compresses a spring 33. With such movement, the cam follower 15, fixed in the gun barrel interior, rides in a helical groove 35 in the shaft 32, and causes the shaft as well the fuse assembly 50 in the socket end 40 to rotate relative to the gun-like structure and lock the fuse 70 in the block 60.

When the pressure in the first direction 39*a* is released, and the holder 12 is moved in the second direction 39*b*, the spring 33 returns the shaft 30 to its first position 30 and the trigger under the force of the resilient compression spring member 27 returns to its first position 22', and permits placement of the accompanying holders or caps 50 into a plurality of closely spaced fuse blocks 60 which may be accomplished according to the invention described herein by a tool generally indicated at 10. The tool holds the fuse and cap and converts linear movement toward the block 60 into a rotary movement that twists the fuse and holder a predetermined amount to fix it into position securely in the fuse block From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A fuse insertion tool comprising:

a head adapted to grip a fuse device;

a shaft having a first and a second end, said first end connected to said head;

said shaft being movably mounted in a holder, said shaft being mounted in said holder for linear movement;

a resilient biasing means between said second end of said shaft and said holder; and a shaft rotating device between said holder and said shaft for converting linear movement of said shaft to rotary motion, wherein said holder further comprises a shaft release mechanism engaging said shaft wherein when said release mechanism is engaged said shaft is held relatively stationary against linear movement in said holder, and when said release mechanism is disengaged, said shaft is released and permitted to move linearly into said holder and against said resilient biasing means;

wherein said shaft release includes a trigger mechanism having a first end and a second end;

said trigger mechanism being pivotally mounted on said holder between said first end and second end of the trigger mechanism; and said trigger mechanism being pivotally moveable between a first position where said first end of the trigger mechanism is in engagement with said shaft to immobilize said shaft, and a second position where said first end of the trigger mechanism is out of engagement with said shaft to allow such shaft to move linearly in said holder.

2. A fuse insertion tool according to claim 1, wherein said head is further adapted for coupling to a generally cylindrically shaped fuse cap.

3. A fuse insertion tool according to claim 1, wherein said head is adapted for coupling to a generally square shaped fuse cap.

4. A fuse insertion tool according to claim 1, wherein said head is further adapted to include a socket, said socket having an inner configuration corresponding to the outer configuration of said cap and mating with said cap configuration.

5. A fuse insertion tool according to claim 1, wherein said shaft rotating mechanism is comprised of a helical groove in the said shaft and a cam follower fixedly mounted on said holder extending into said groove.

6. A fuse insertion tool accordingly to claim 5, wherein the helical groove in said shaft is oriented to rotate said shaft clockwise about 90°.

7. A fuse insertion tool according to claim 1, wherein the second end of the trigger mechanism forms a finger hold.

8. A fuse insertion tool according to claim 1, wherein said holder has a gun-like shape with a generally barrel shaped portion having a first end and a second end, wherein said shaft is received in a barrel recess through an opening in said first end of the barrel shaped portion, said second end of the barrel shaped portion having a depending hand grip handle portion adapted to be grippable by the hand of a user.

9. A fuse insertion tool according to claim 8, wherein said trigger mechanism is further comprised of a resilient member biasing said first end of said trigger mechanism into said first position.

10. A fuse insertion tool according to claim 1, wherein said holder is molded plastic.

11. A fuse insertion tool according to claim 1, wherein said head is adapted for coupling with a fuse cap having a pair of projections extending from opposite sides of a circular portion said cap.

12. A fuse assembly insertion tool for inserting a fuse and cap assembly comprising a fuse assembly and a fuse cap into a fuse block having a detent, comprising:

a holder having a tool head adapted to receive and grasp a head of a fuse assembly, said tool head being coupled to a rotatably mounted shaft, said shaft being partially recessed in said holder, said shaft being movable between a first position adapted to hold said fuse assembly in one of a first position and a second position in which said tool head and shaft have been rotated;

a trigger mechanism having a first position holding said shaft and tool head so that they cannot move and rotate, and a second position in which said shaft and tool head are free to move and rotate;

a shaft and tool head rotating mechanism for translating linear movement of said shaft into rotation to rotate said shaft;

wherein responsive to moving said tool linearly in a first direction, said fuse assembly and said fuse cap are fully inserted into the fuse block while depressing a spring in the fuse cap between the fuse assembly and the fuse cap;

wherein the trigger mechanism is responsive to pressure for releasing the shaft connected to said tool head, for causing the shaft and tool head rotating mechanism to translate the applied linear motion into rotation, causing the fuse head therein to rotate a predetermined number of degrees such that the fuse and cap holder engage the detent in the fuse block.

13. The tool as in claim 12, further comprising:

apparatus for moving the tool head in a second direction away from the fuse cap after insertion of the fuse assembly and fuse cap into the fuse block.

* * * * *